United States Patent [19]

Carrion et al.

[11] 4,312,197

[45] Jan. 26, 1982

[54] DEVICE FOR PREVENTING OR EFFECTING THE UNLOCKING OF THE TRUNK LID OF AN AUTOMOBILE VEHICLE

[75] Inventors: Jean-Pierre Carrion, Courbevoie; Christian Le Buhan, Elancourt, both of France

[73] Assignee: Regie Nationale des Usines Renault, Boulogne-Billancourt, France

[21] Appl. No.: 102,456

[22] Filed: Dec. 11, 1979

[30] Foreign Application Priority Data

Dec. 11, 1978 [FR] France ..... 78 34739
Jun. 18, 1979 [FR] France ..... 79 15498

[51] Int. Cl.[3] ..... E05B 65/06

[52] U.S. Cl. ..... 70/135; 70/240; 292/341.16; 292/DIG. 14; 292/DIG. 25; 292/DIG. 43

[58] Field of Search ..... 70/135, 137, 240, 241; 292/DIG. 3, DIG. 14, DIG. 25, DIG. 43, 341.16

[56] References Cited

U.S. PATENT DOCUMENTS

| | | | |
|---|---|---|---|
| 2,749,166 | 6/1956 | Linder | 292/DIG. 43 X |
| 2,795,947 | 6/1957 | Peras | 292/DIG. 14 |
| 3,016,968 | 1/1962 | Lenz et al. | 292/DIG. 43 X |
| 3,113,447 | 12/1963 | Oislei | 292/DIG. 43 X |
| 3,785,186 | 1/1974 | James et al. | 70/240 |
| 4,045,064 | 8/1977 | Okada | 292/DIG. 14 X |

FOREIGN PATENT DOCUMENTS

| | | | |
|---|---|---|---|
| 2603365 | 1/1976 | Fed. Rep. of Germany | 70/240 |

*Primary Examiner*—William E. Lyddane
*Attorney, Agent, or Firm*—Oblon, Fisher, Spivak, McClelland & Maier

[57] ABSTRACT

A device comprising a lock with a rotating knob and incorporated bolt, capable of being blocked by the release of the rotating-knob unlocking control. The release results from the shifting of a blocking lever 13, 113 of the plate of the lock. The lever is operated by either a remote-controlled driving organ, or directly by the cylinder bolt. The blocking lever can, in addition, be inhibited by a locking lever 55, 155 operated from inside the trunk so as to neutralize the remote control.

10 Claims, 24 Drawing Figures

11
12
8
13
59
51
49
58
57
55b
47
48
50
46
50a
41a
41
56
41b
55c
53
52
43
54
50b
II
7a
II
61
37
41c
40
44
14
15
+

DEVICE FOR PREVENTING OR EFFECTING THE UNLOCKING OF THE TRUNK LID OF AN AUTOMOBILE VEHICLE

BACKGROUND OF THE INVENTION

1. Field of the Invention

The present invention relates to a combined device designed both to block, and to effect, the unlocking of a closure such as the trunk lid or tailgate of an automotive vehicle.

2. Description of the Prior Art

It is known that there are trunk lid locks that are released by the operation of a rotating knob, the blocking of the knob being assured by means of an incorporated bolt whose cylinder or tumbler is turned with a key.

It is also known that there are trunk locks operated by electrical or pneumatic remote control from a central point inside the vehicle, or simultaneously with the locking of the side doors, unlocking of the trunk lid being usually effected by the operation of a push-button bolt.

Such devices do not permit unlocking of the side doors independently of the trunk lid, without a more intricate electrical control circuit.

SUMMARY OF THE INVENTION

The object of the present invention is to provide a new device which permits both the blocking and the unblocking of the trunk lock, either by an electromagnetic remote-control actuator inside the vehicle or by the locking of the side doors from the outside, or by a tumbler bolt incorporated into an independent trunk unlocking device operated by a rotating knob.

The device according to the invention also offers the possibility of blocking and unlocking by remote control by allowing such unlocking to be effected only by the bolt, i.e. the trunk lock or by the use of a special lever reachable from inside the trunk.

This novel combination of functions requires specially designed bolts and lock plates in order to implement the object of the invention. Inhibition of the unlocking procedure is obtained by releasing the rotating knob; this prevents forcing of the lock if an attempt is made to break open the trunk.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 2:
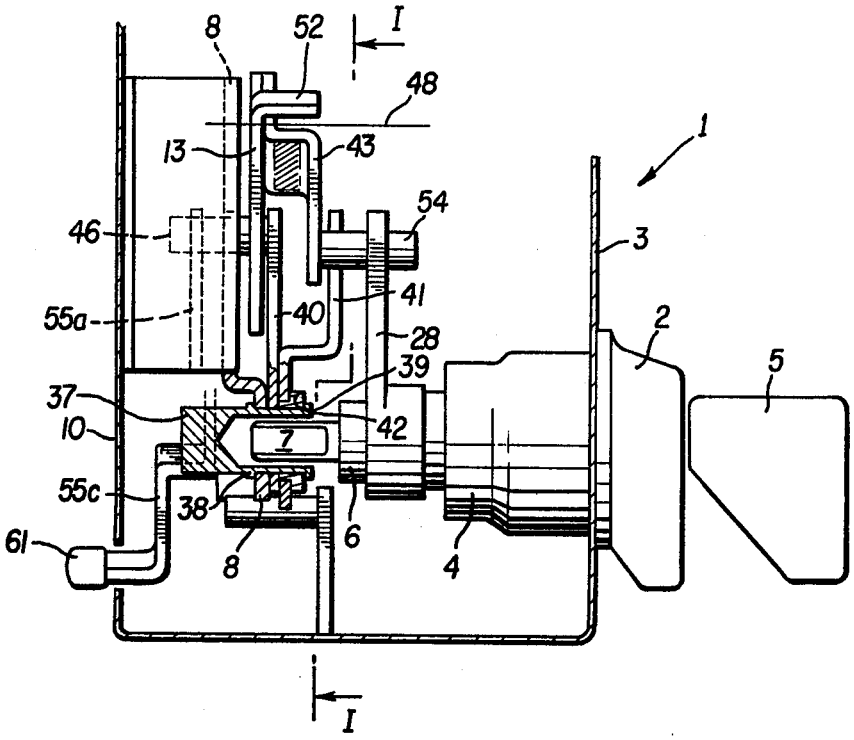
FIG. 2 is a sectional view along line II of FIG. 1, showing the bolt-plate connection.

As can be seen in FIG. 2, the device of the invention is essentially composed of an unlocking control for trunk lid or tailgate 1 and includes rotating knob 2 mounted through outside panel 3 of the vehicle body, in the center of which is located tumbler bolt 4 activated from the outside by means of key 5.

The control knob-bolt group comprises two coaxial and independent projecting shafts 6 and 7, which engage, respectively, a succession of mechanical angle levers which are part of a lock plate 8 located in the housing 9 in the lid which is mounted on inside panel 10 of the lid.

In addition, to the various levers, plate 8 carries (FIG. 1) a driving element, in the present case an electromagnetic actuator 11 whose rectilinear alternating shifting of core 12 causes pivoting of a preferred lever, hereafter called blocking lever 13.

The actuator responds to remote-control electrical impulses either from inside the vehicle by means of a reverse contactor 14, or from the outside by means of the electromagnetic locking system in the side doors through the use of a key 15. Thereby, the user can block simultaneously every access when leaving his vehicle or release access to the trunk from inside the vehicle, without having to remove his key ring from the ignition and thus stopping the engine needlessly.

Figure 9:
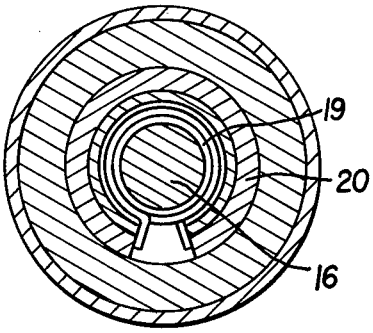

Bolt 4 shown in detail in FIGS. 3 to 10 comprises, from the center to the periphery, a rotor or cylinder 16 of the tumbler 17 type, operated by key 5 inserted through rotating knob 2 in slot 18 provided for this purpose. The rotor is extended by a tail 7 whose extremity makes it possible to block or unblock the lock, through interposed levers, in the direction of the rotation of key 5. In accordance with FIG. 4, key 5 always returns to its stable middle or resting position under the impulse of a spiral spring 19 located in cylinder 16, whose extremities rest on stator 20 surrounding the cylinder (FIG. 9). Rotation of the key to the left as in 5*a* (FIG. 4) corresponds to the unblocking of the lock which logically precedes the unlocking of the lid by rotation of knob 2 in the same direction, rotation of the key in the opposite direction 5*b* naturally being reserved for blocking.

Figures 3, 4, 5, 8:
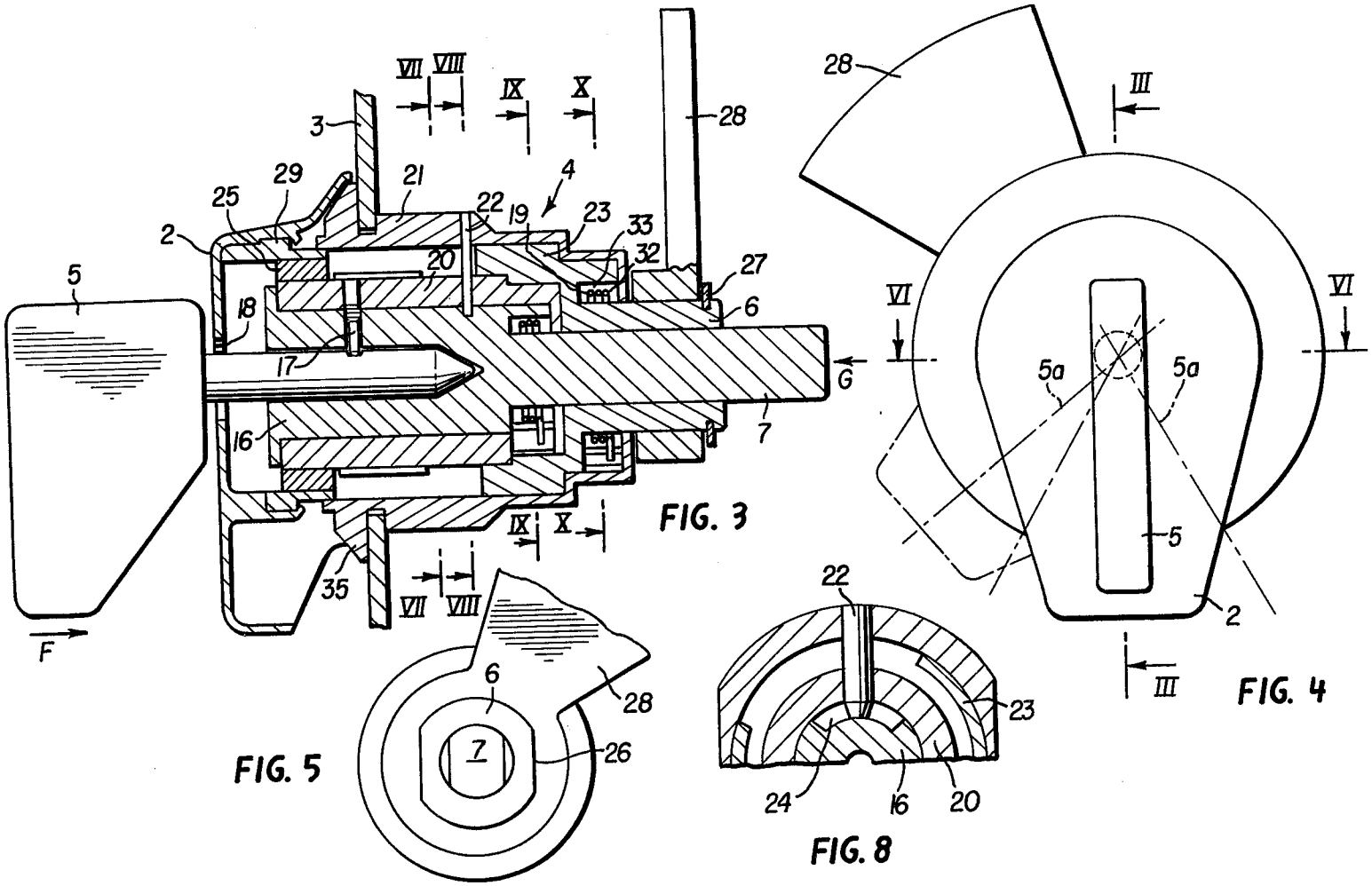
FIGS. 3 and 6 are longitudinal sections of the lock along lines III and VI, respectively in FIG. 4.
FIGS. 4 and 5 are end views of the lock along arrow F and G, respectively in FIG. 3.
FIGS. 7 to 10*b* are cross-sections of the lock along lines VII to X, respectively, in FIG. 3.
Figure 6:
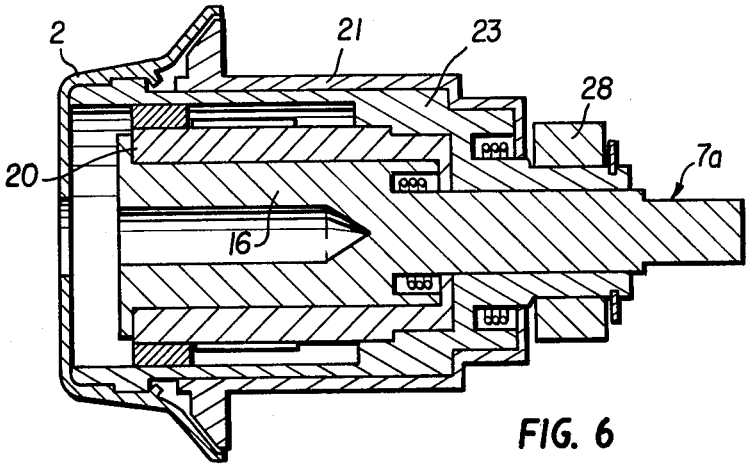

Cylinder 16 is anchored to the outside body 21 of the bolt by means of pin 22 perpendicular to the principal axis of the bolt and which traverses, in succession, bolt body 21, knob body 23 and stator 20, and rests on cylinder 16. Sector 24 is provided on the cylinder 16 and is of an extent to correspond to the angular deflection of the cylinder due to key 5 (FIG. 8).

The body of the rotating knob 23 envelops the stator 20 with the interposition of a ring 25 which forms a bearing. The knob 23 extends around the tail 7 of the cylinder so as to guide the latter and to form a protruding shaft 6 to which is fixed against rotation (due to flat surfaces 26, FIG. 5) and against translation movement (due to retaining ring 27), a sector-shaped cam is provided for the unlocking operation.

Rotation of the body of the knob 23 is effected from the control knob 2, connected by a retaining ring to the outside extremity 29 of the knob body 23. Rotation can only be in the direction of unlocking 5*a* (FIG. 4) owing to the presence of a thrust plate 30 on the knob body (FIG. 10*a*), the amount of rotating being determined by the length of a curvilinear sector 31 provided in knob body 23.

Figure 10A:
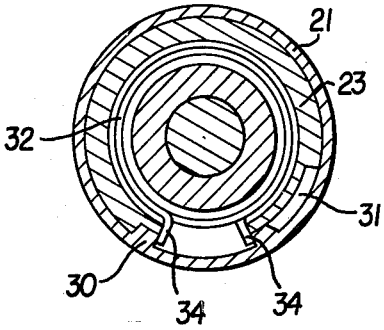
Figure 10B:
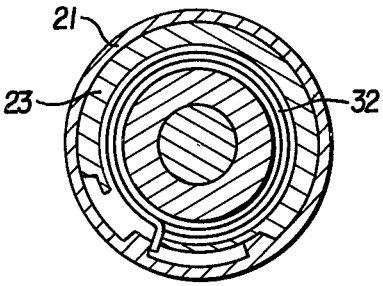

FIGS. 10*a* and 10*b* show the limited rotation of the knob body 23 going from its resting position (FIG. 10*a*) to its unlocking position (FIG. 10*b*) constraining a spiral spring 32 located in an annular groove 33 in the knob body (FIG. 3), the extremities 34 of said spring resting on thrust plate 30 and seen in superposition in FIG. 10*b*.

Figure 7:
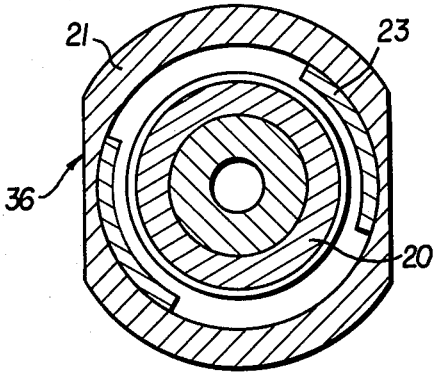

Bolt body 21, the outside protective element, envelops the elements described above, except for the protruding shaft of the cylinder 7 and of the knob body 6. The bolt body is fixed in a corresponding cutout in the sheet metal of automobile body 3, resting on its outside ring 35, rotation being prevented by flat surfaces 36 (FIGS. 3 and 7).

Figure 1:
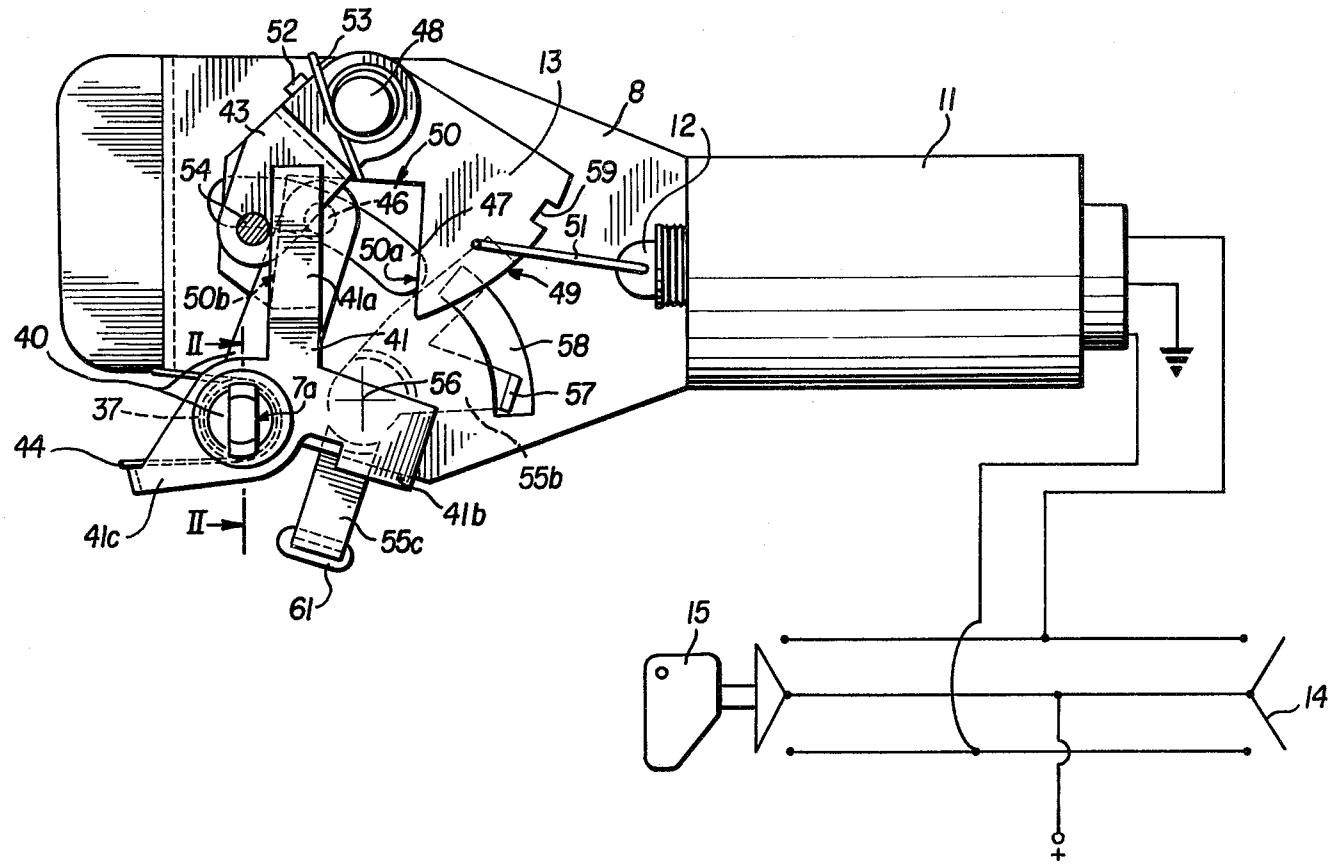
FIG. 1 is a view along line I of FIG. 2 of the lock plate carrying the remote-control actuator.

Referring to FIGS. 1 and 2, the lock plate 8 made of bent sheet metal, carries, in addition to the electromagnetic actuator 11, a series of levers distributed as follows:

A hollow bearing 37 designed to take the tail 7 of the cylinder, is positioned so as to pass through a bore hole in plate 8 and to rest on the latter by means of a ring 38. Between this ring and the crimped extremity 39 of the bearing, two adjacent levers are held, parallel to plate 8. They are respectively a blocking operation lever 40 and an unlocking lever 41, the latter pivoting around bearing 37 with the interposition of a ring 42. The unlocking lever 41 is in fact composed of three branches disposed in the form of a star, whose vertical branch 41*a*, in FIG. 1, can be rotated in the permissible direction by an intermediate unlocking lever 43.

At rest, unlocking lever 41 abuts with its second branch 41*b* against an edge of plate 8, pressed by return spring 44 wound around bearing 37 and hooked to plate 8 at one end, and to the third branch 41*c* of the unlocking lever at the other end.

Figure 11:
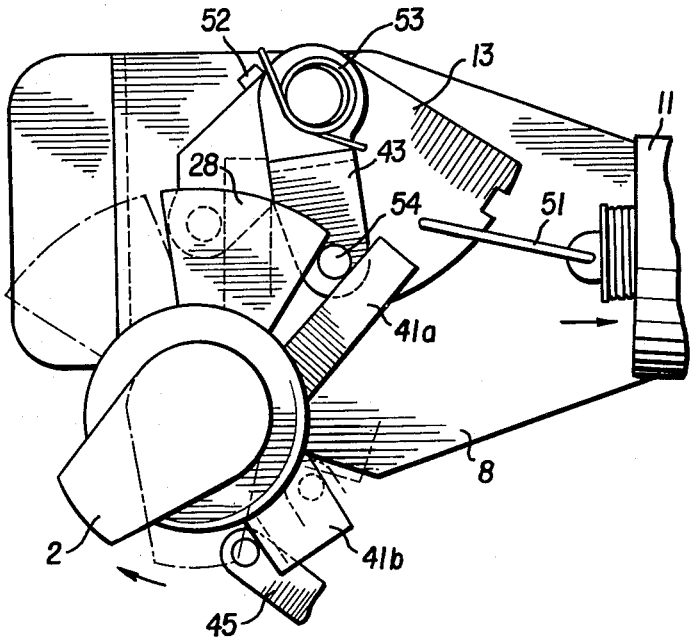
FIG. 11 shows the unlocking operation by rotating the knob, the lock being unblocked.

As can be seen in FIG. 11, the abuting branch 41*b* of the unlocking lever causes the pivoting of an action lever 45 of the latch of the lock, outside plate 8, so as to unlock the lid as a result of the rotation of knob 2.

The lever 40 (FIGS. 1 and 2) which causes blocking, is engaged directly by tail 7 of the cylinder which traverses it and tail 7 features two flat surfaces 7*a* which effect the rotational connection with lever 40.

Thus, rotation of key 5 causes the pivoting of blocking lever 40 as well as rotation of bearing 37 which is integral with it by the portion comprised between ring 38 and crimping 39.

The other extremity of blocking lever 40 carries, in addition, a lug 46, riveted at right angle to it, traversing a curvilinear slot 47, bored in plate 8, whose length is appropriate to the various phases of operation described below.

Lug 46 of blocking lever 40 causes the pivoting of blocking lever 13 hinged to plate 8 on an axis 48, the blocking lever featuring a generally sector-like shape whose curvilinear side 49 is cut out along an aperture 50 whose inside edges 50*a* and 50*b* are acted upon like cams by lug 46.

The branch of blocking lever 13 closest to actuator 11 is connected to the latter's protrusion 12 by means of a small bar 51.

Figure 16:
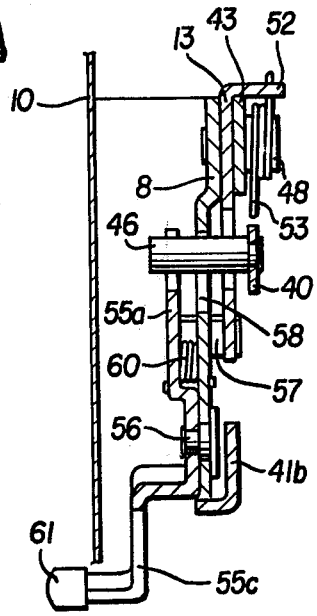
FIG. 16 is a cross-section of the lock plate along line XVI in FIG. 15.

The axis 48 serves also as a hinge for intermediate unlocking lever 43 which abuts at 52 against blocking lever 13, constrained by spiral spring 53 wound around hinge 48 and hooked to each of the two levers facing each other (FIGS. 1 and 16).

Intermediate unlocking lever 43 also carries at its other extremity a lug 54, riveted at a right angle to it, but in an opposite direction to lug 46 of blocking lever 40, and sufficiently long to be acted upon by pin 28 of knob 2 on the one hand, and to cause the pivoting of the vertical branch 41*a* of the unlocking lever, on the other hand (FIGS. 2 and 11). Similarly, lug 46 of blocking lever 40 is sufficiently long to act in the proper direction on blocking lever 13, on the one hand, and to engage on the other side of plate 8 (FIGS. 2 and 16) the first branch 55*a* of another three-branch lever, called a locking lever, which is hinged to the plate around an axis 56.

The second branch 55*b* of the locking lever comprises a short perpendicular arm 57 that traverses a second curvilinear aperture 58 in the plate. The arm 57 is capable of fitting in a slot 59 cut out in the curvilinear side 49 of blocking lever 13 so as to lock the latter when it assumes its blocked position, represented in FIG. 15.

Figure 15:
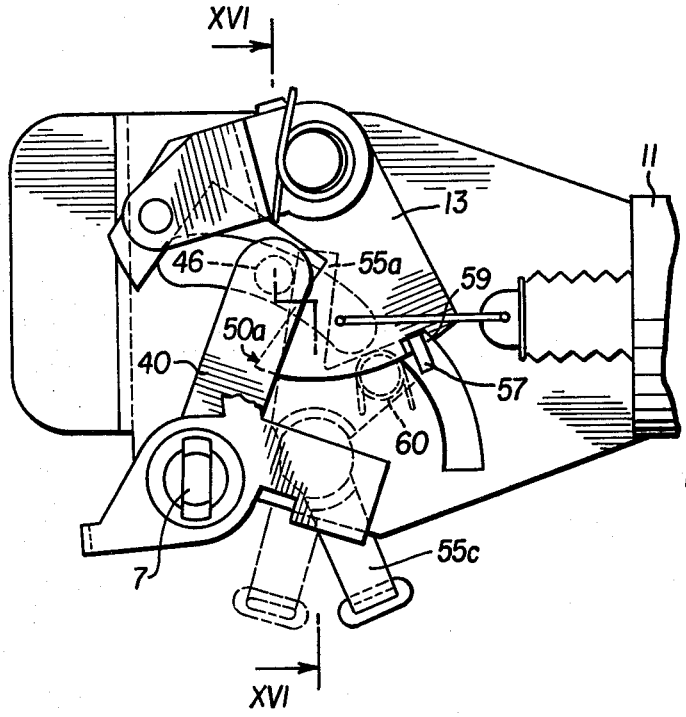
FIGS. 15 and 17 show the neutralization and the release, respectively, of the remote control operation by means of the bolt.
Figure 17:
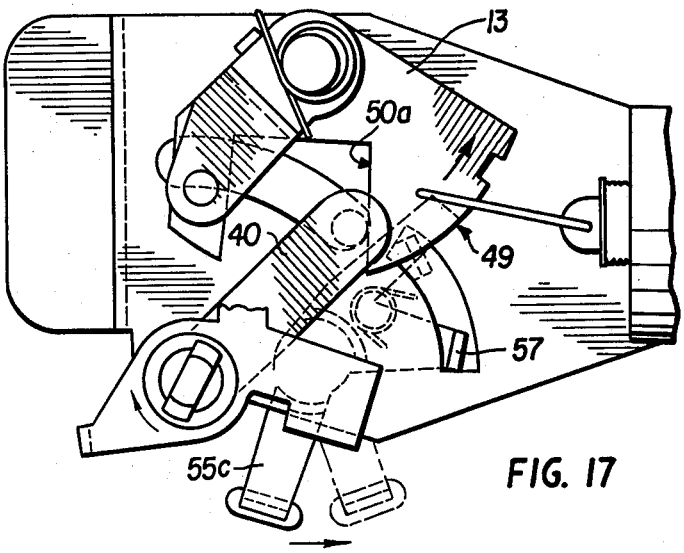

Further, a spiral spring 60, hooked between plate 8 and the second branch 55*b* of the locking lever, provides the latter with two stable positions, represented, respectively, in FIGS. 15 and 17.

Finally, the third branch 55*c* of the locking lever ends in a control button that traverses the inside panel 10 of the lid and is thus accessible from inside the trunk; its role is described below.

In unlocking the lid (FIGS. 2 and 11), the lock being unblocked, i.e. blocking lever 13 being in the position shown, the knob is turned clockwise (solid lines), which causes, in succession, rotation of knob body 6, of pin 28, of intermediate unlocking lever 43 by lug 54, of unlocking lever 41*a*, 41*b* and of latch-activating lever 45.

When knob 2 is released after the unlocking, springs 32, 53 and 60 cause the lever to return to their respective resting positions with intermediate unlocking lever 43 abuting at 52 against blocking lever 13 and unlocking lever 41 abuting against plate 8.

Figure 12:
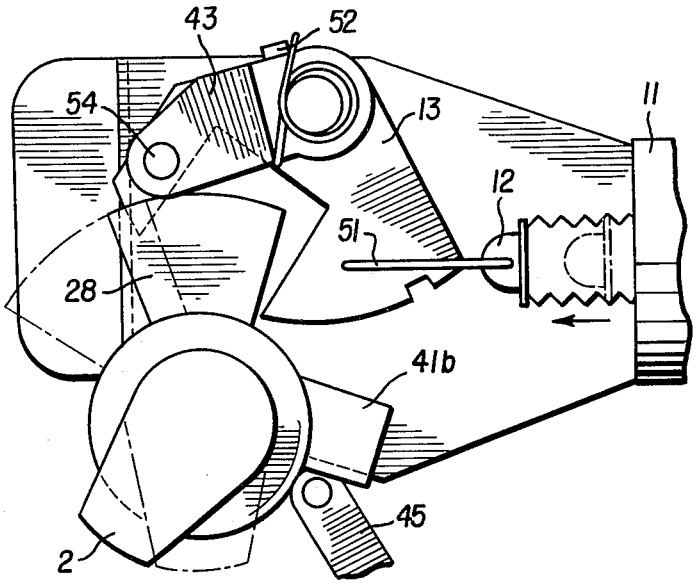
FIG. 12 shows the release of the rotating knob resulting from the blocking of the lock.

Blocking of the lock (FIG. 12) will now be described. To block the lock it is enough to cause the pivoting of blocking lever 13 toward the position shown, either by remote control with actuator 11, or with lock cylinder 16.

Intermediate unlocking lever 43, integral with blocking lever 13, pivots together with the latter, in such a manner that lug 54 escapes the trajectory of pin 28 controlled by rotating knob 2. Thus the blocking results from the release of the rotating knob whose operation then is without effect on the lid-unlocking lever 45.

Blocking and unblocking by remote control (FIGS. 11 and 12) is accomplished by an electrical impulse generated either inside the vehicle by reversing contactor 14, or from the outside by key 15 operating the electromagnetic locking of the side doors. The impulse energizes the coil of actuator 11 whose core 12 is shifted, causing the pivoting of blocking lever 13 connected by bar 51, either in the direction of blocking (FIG. 12) or in that of unblocking (FIG. 11).

Figure 13:
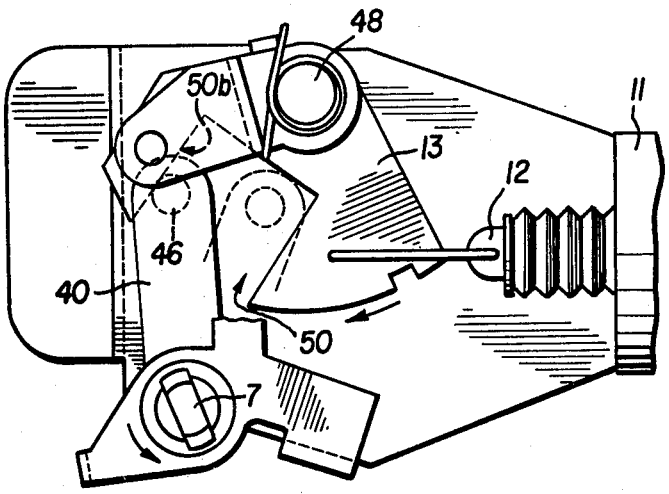
FIGS. 13 and 14 show the blocking and the unblocking, respectively, of the lock by the tumbler bolt.
Figure 14:
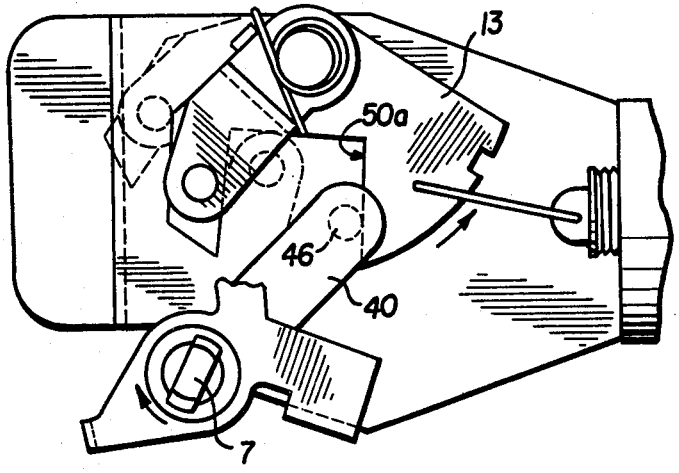

Blocking and unblocking by means of the lock (FIGS. 2, 13 and 14) is accomplished by rotation of tail 7 of the cylinder, in the proper direction, by means of the lock key which causes the rotation of blocking control lever 40 whose lug 46, in turn, causes the pivoting of blocking lever 13 by cam-effect on edges 50*a* and 50*b* of aperture 50, either in a blocking direction (FIG. 13) or in an unblocking direction (FIG. 14).

In pivoting, blocking lever 13 causes the shifting of actuator core 12, so that the lock blocked by the bolt can subsequently be unblocked by remote control, by means of actuator 11, and vice-versa.

Neutralization and release of unblocking by remote control is accomplished (FIGS. 15, 16 and 17) where the lock being unblocked and blocking lever 13 being in the position shown in FIG. 17, the user unlocks the trunk lid as indicated above and manually trips locking lever 55*c*, accessible from the inside, from its initial stable position (in solid lines) to its second stable position (broken lines) so that arm 57 is made to abut against curvilinear side 49 of blocking lever 13.

After closing the trunk, the user blocks the lock (FIG. 13) with the tumbler bolt 7, which causes blocking lever 13 to switch to the position shown in FIG. 15 in which arm 57 of locking lever 55 comes to fit into slot 59 in blocking lever 13 under pressure from spring 60. As a result, the locking of blocking lever 13 makes impossible unblocking by actuator 11.

The unlocking of lever 13 and the release of remote control 11 can be effected only by means of the lock.

Starting at FIG. 15, rotation of cylinder 7 causes the pivoting of unblocking control lever 40, whose lug 46 meets the first branch 55*a* of the locking lever so as to trip it, thereby releasing it from slot 59 in blocking lever 13.

In the course of its trajectory, lug 46 then meets edge 50*a* of the aperture in blocking lever 13, and trips it in turn (FIG. 17).

Thus, rotation of cylinder 7 achieves by this one motion, in succession, release of remote control and unblocking of the lock so that the lid can be unlocked.

The embodiment described below allows for the same operations as those provided by the above device, but in accordance with simpler, less expensive and less bulky design, by which the latch-activating lever can be operated directly by a slight rotation of the blocking lever that acts at the same time as unlocking lever. This eliminates, incidentally, the intermediate unlocking lever of the foregoing embodiment.

Blocking-unblocking of the lock by release of the rotating knob is no longer achieved by the rotation itself, but by an additional translatory motion of the blocking lever, which thus does double duty (blocking and unblocking) in accordance with the motion applied to it (translation and rotation, respectively) either through manual operation of the rotating knob or by remote—such as electromagnetic-control.

It must also be observed that combining the blocking and unlocking levers in a single lever, does away with the three-branch unlocking lever and its complicated shape.

The rotating-knob bolt does not undergo any internal modification. In order to adjust to the new structure of the blocking lever, the only modifications involve transmission of motion at the extension of the cylinder whose tail now directly supports the blocking control lever, following the elimination of the hollow bearing surrounding the tail of the cylinder which before carried the blocking control lever and the multi-branch unlocking lever.

The same terminology is to be used as for the principal embodiment to designate elements or parts fulfilling the same function, the corresponding reference numbers being shifted by one hundred in order to differentiate the present embodiment.

Figure 18:
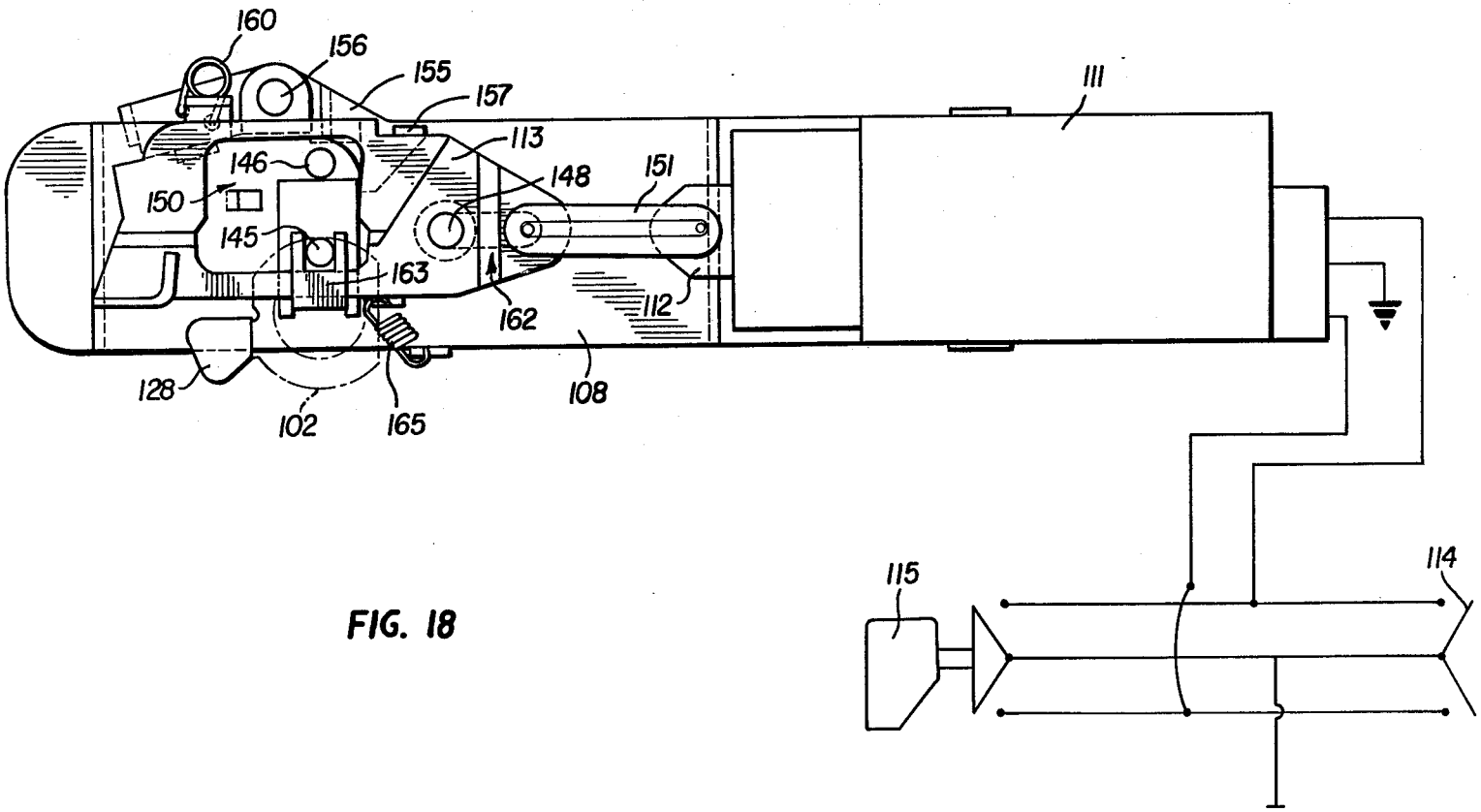
FIG. 18 is a variant of the device and of its remote control mechanism.
Figure 22:
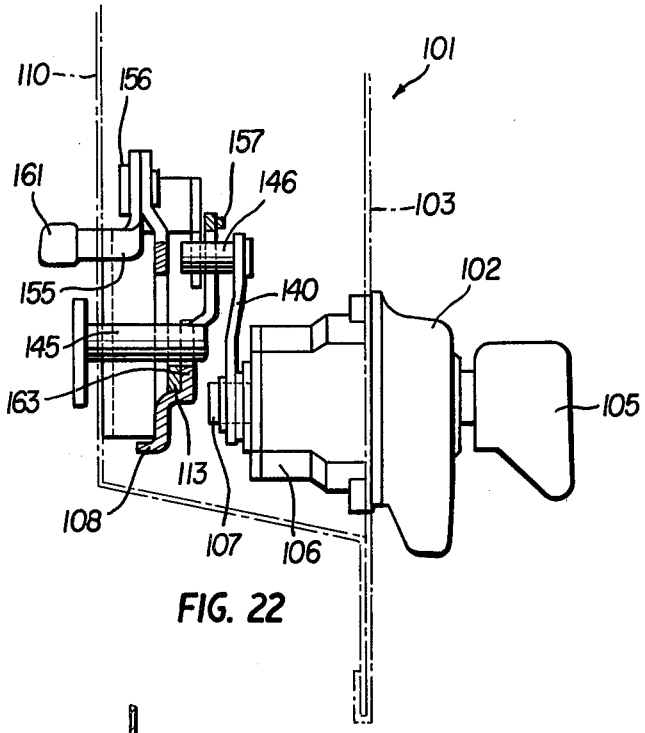
FIG. 22 is a cross-section along line XXII in FIG. 19.

FIGS. 18 and 22 show plate 108 of the lock mounted in the housing of the door 101 and carrying the various levers of the mechanism operated by the same elements as those of the principal embodiment, i.e. either from an electromagnetic remote-control actuator 111 operated by a reverser 114 inside the vehicle or by means of key 115 effecting the electromagnetic locking of the side doors, or from a rotating knob, incorporating a tumbler bolt mounted on the trunk lid or tailgate 101 and operated by key 105.

Figure 23:
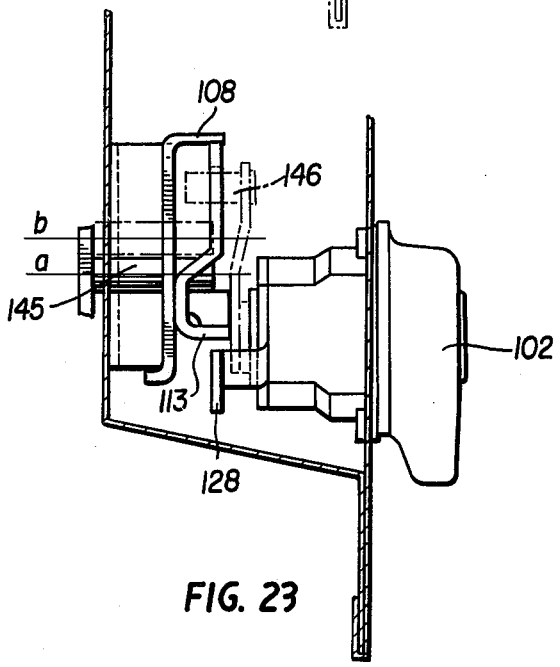
FIG. 23 is a side view along arrow XXIII in FIG. 19.

The coaxial, protruding shafts 106 and 107, independent of the knob body and cylinder engage directly and respectively pin 128 for the unlocking operation (FIG. 23) and blocking control lever 140 (FIG. 22) whose lug 146 traverses aperture 150 cut out in lever 113, called common lever, which in accordance with the invention insures both the blocking/unblocking of the lock and the unlocking of the lid by being given in succession a translatory and then a rotational movement.

Common lever 113 is thus mounted so as to hinge on plate 108 by means of an axis 148 that is integral with the lever and can be moved with it in a translatory motion through a rectilinear aperture 162 in the plate. The lever is then guided in a translatory movement, parallel to plate 108 by a lug 163 stamped out of the plate, the travel distance of the lever being limited by the length of aperture 162. Common lever 113 can be shifted in translatory movement in the direction of blocking (FIG. 19) or of unblocking (FIG. 20) by means of mobile core 112 of the electromagnetic actuator 111 to which it is connected by small bar 151.

The common lever can also be given translatory movement by the pivoting of blocking control lever 140 whose lug 46 encounters in its curvilinear trajectory the vertical edges 150*a* and *b* of aperture 150 cut out of common lever 113, and it acts on the latter by cam effect.

In the blocked position (FIG. 19), common lever 113 may be locked in that position by means of a locking lever 155 which is hook-shaped and is mounted on the plate so as to hinge on axis 156.

The head of the hook features lug 157 which is able to fit into slot 159 of the common lever so as to make impossible the latter's translatory shift by actuator 111 in the direction of unblocking.

Figure 19:
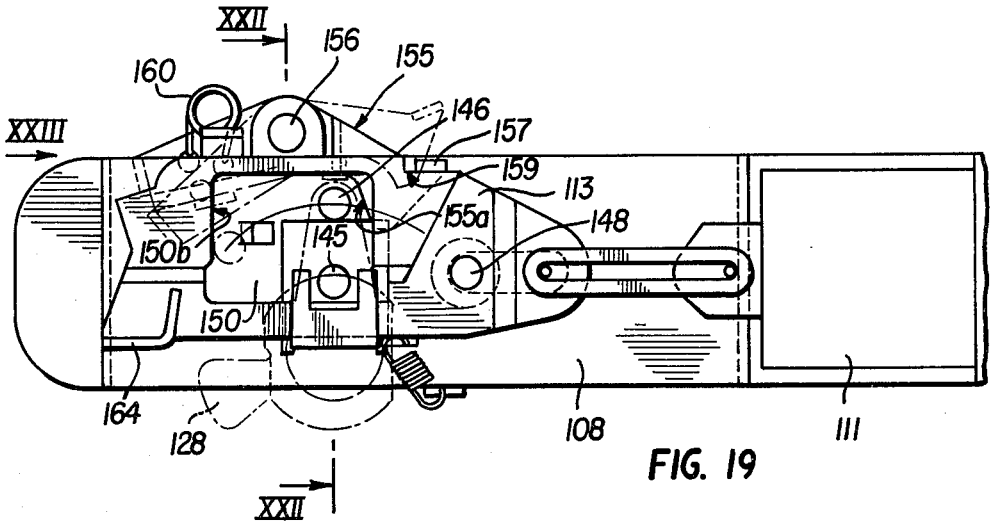
FIGS. 19, 20 and 21 show the device in the blocked, unblocked and unlocked position, respectively.

The other branch of locking lever 155 (FIG. 22) features operating button 161 which traverses housing 110 and is accessible from inside the trunk so as to manually place the locking lever in one of the two positions represented in FIG. 19, positions that are stabilized by a spiral spring 160 hooked between said lever and plate 108.

From outside the vehicle, the unlocking of common lever 113 by locking lever 155 can be effected only by means of blocking control lever 140 operated by key 105 of the lock.

Figure 20:
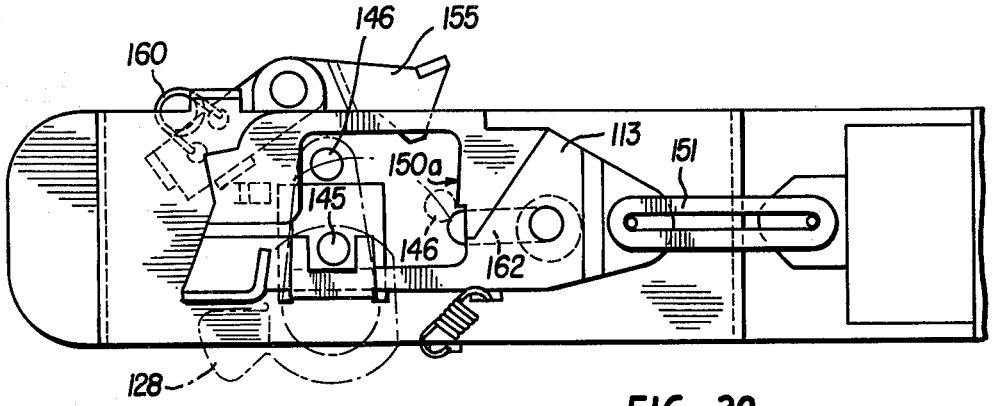

Lug 146 then impinges on internal ramp 155*a* of the head of the hook (FIG. 19) so as to trip locking lever 155 to its second stable position (broken lines) and release common lever 113, prior to its deblocking (FIG. 20).

Figure 21:
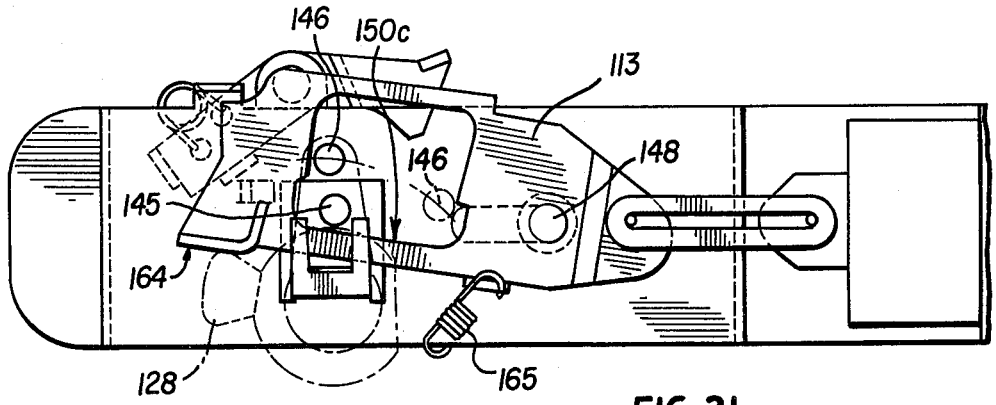

Rotation of the common lever from its unblocked position, for the purpose of unlocking of the lid, is accomplished (FIG. 21) by turning rotating knob 102 whose exit pin 128 presses on a thrust plate 164 which is produced, for example, by cutting out and folding the lower edge of common lever 113 in the interest of simplified fabrication.

In the course of its pivoting, biased by spring 165 hooked onto the plate, the common lever imparts enough travel to control axis 145 of the latch of the lock to activate the latch. The axis traverses aperture 150 of the common lever and is acted upon directly by lower edge 150*c* of said aperture.

In the blocked position (FIG. 19), release of the rotating knob results from the fact that the trajectory of pin 128 avoids thrust plate 164 owing to the translatory movement of common lever 113 in the direction of blocking, i.e. to the left in FIG. 19.

Thus, this embodiment permits the same operations as those described in the principal embodiment, to wit: blocking and unblocking by remote control, blocking and unblocking by the lock, neutralization and release of remote-control unblocking (locking), and unlocking of the lid.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for blocking or unlocking a closure of a vehicle, said device comprising:

release latch means for said closure;

a lock mounted on said closure, said lock including a rotatable knob and a bolt;

blocking lever means mounted on said plate and actuatable by said bolt and said knob, said blocking lever means being movable from an unblocking position wherein said blocking lever means transmits motion of said knob, to a blocking position wherein said blocking lever means is released from transmitting motion of said knob; wherein said knob engages a cylindrical knob body having a pin at one end, said pin contacting a first intermediate lever to activate said release latch means of said closure via said blocking lever means upon the rotation of said knob when said unblocking lever means is in said unblocking position, and wherein said bolt is concentric with said knob and includes a lock cylinder which is rotatable in one of two directions independently of said knob, wherein said bolt engages a second intermediate lever and the rotation of said bolt causes said second intermediate lever to contact and move said blocking lever means into one of said blocking and unblocking positions, wherein said blocking lever means may also be actuated by a remote controlled driving organ.

2. Device in accordance with claim 1, wherein said bolt is constituted successively, from the center to the periphery, by a tumbler cylinder biased by a spring, by a fixed stator that surrounds said cylinder and is cottered to a cylindrical outside bolt body mounted on the vehicle body, and by said knob body which swivels between the stator and the bolt body and is biased by a second spring.

3. The device of claim 1, including a locking lever mounted on said plate, said locking lever being movable into two stable positions from inside said vehicle, one of which contacts said blocking lever means and locks said blocking lever means in said blocking position, whereby said remote controlled driving organ is neutrallized.

4. The device of claim 3, wherein said second intermediate lever is a blocking control lever including a lug and wherein said blocking lever means includes an aperture, wherein movement of said blocking control lever causes said lug to contact the edges of said aperture and to move said blocking lever by camming said edges of said aperture.

5. The device of claim 4, wherein said locking lever includes a secondary branch and wherein said blocking control lever is constructed so that the movement of said lug can contact said secondary branch and move said locking lever into the second said stable position wherein said blocking lever means is unlocked.

6. The device of claim 1 wherein said blocking lever means includes a blocking lever and an intermediate unlocking lever including a second lug mounted to said plate at the mounting point of said blocking lever and elastically abutting said blocking lever, wherein said first intermediate lever is an unlocking lever including a release latch unlocking portion and wherein said unlocking lever and intermediate unlocking lever are so constructed that, when said blocking lever means is in said unblocking position, the movement of said pin causes said pin to contact said second lug and move said second lug into contact with said unlocking lever to move said unlocking lever and said release latch.

7. The device of claim 6, wherein said unlocking lever swivels around a hollow bearing carried by said plate and into which fits the tail of said cylinder and which engages said blocking control lever.

8. The device of claim 1, wherein said driving organ is an electromagnetic actuator mounted on said plate and connected by a small bar to said blocking lever means.

9. The device of claim 1 wherein said first intermediate lever is formed unitary with said blocking lever means and said second intermediate lever is fixed to said bolt.

10. The device of claim 9 wherein said blocking lever means is a plate having an aperture.

* * * * *